US007775611B1

(12) United States Patent
Solis

(10) Patent No.: US 7,775,611 B1
(45) Date of Patent: Aug. 17, 2010

(54) MOP HOLDING DEVICE

(76) Inventor: Eduvijes Solis, 34579 Wintersweet La., Winchester, CA (US) 92596

( * ) Notice: Subject to any disclaimer, the term of this patent is extended or adjusted under 35 U.S.C. 154(b) by 0 days.

(21) Appl. No.: 12/412,326

(22) Filed: Mar. 26, 2009

(51) Int. Cl.
*A47G 29/08* (2006.01)

(52) U.S. Cl. ..... 312/207; 312/206; 312/211; 312/229; 312/245

(58) Field of Classification Search ..... 206/361, 206/207, 209, 209.1, 320, 362.3, 349; 312/206, 312/207, 245, 246, 247, 211, 229; 211/65; 248/110
See application file for complete search history.

(56) References Cited

U.S. PATENT DOCUMENTS

| | | | | | |
|---|---|---|---|---|---|
| 1,476,599 | A | * | 12/1923 | De Witt | 211/62 |
| 2,373,339 | A | * | 4/1945 | Roberts | 34/562 |
| 2,584,219 | A | * | 2/1952 | Murrell | 312/207 |
| 2,660,313 | A | * | 11/1953 | James | 210/323.1 |
| 2,820,685 | A | * | 1/1958 | Bergholt | 312/207 |
| 3,780,874 | A | | 12/1973 | Stacy, Sr. | |
| 4,638,910 | A | | 1/1987 | Bokmiller | |
| D296,833 | S | | 7/1988 | Slattery et al. | |
| 4,852,207 | A | | 8/1989 | Yamane | |
| 4,940,139 | A | | 7/1990 | Sandt | |
| 4,974,281 | A | * | 12/1990 | Shaw | 15/261 |
| 5,261,541 | A | * | 11/1993 | Li | 211/62 |
| 5,274,877 | A | | 1/1994 | Morad et al. | |
| 5,335,799 | A | | 8/1994 | Coudron | |
| 5,348,385 | A | * | 9/1994 | Berg | 312/247 |
| 6,036,388 | A | * | 3/2000 | Atcher | 401/118 |
| 6,513,889 | B1 | * | 2/2003 | Park | 312/206 |
| 2005/0061695 | A1 | | 3/2005 | Nogin et al. | |

* cited by examiner

*Primary Examiner*—Mickey Yu
*Assistant Examiner*—Jenine M Pagan

(57) ABSTRACT

A mop holding device comprising a base; a plurality of ventilation holes disposed in the first side wall of the base; a mop opening for receiving the mop disposed at the top edge of the front wall of the base; a support bar for helping to support the mop head attached to the first and second side wall of the base near the front wall; and a removable tray for collecting water from the mop slidably received in an aperture disposed in the first side wall near the bottom wall of the base; wherein the mop is draped over the mop opening such that the head of the mop is inserted into the inner cavity of the base and over the support bar.

7 Claims, 5 Drawing Sheets

MOP HOLDING DEVICE

FIELD OF THE INVENTION

The present invention is directed to a device for storing mops, more particularly a mop storage device that allows for the mop to drain into a tray.

BACKGROUND OF THE INVENTION

Storing wet or damp mops in a closet can often lead to odors as well as the spreading of germs. The present invention features a mop holding device for storing mops in a clean and sanitary way. Excess water from the mop can be quickly and easily drained from the holding device. The mop holding device of the present invention may help to avoid the accumulation of odors and/or germs. The mop holding device of the present invention may help to prevent stains and/or water damage from a wet mop on a floor or against a wall.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
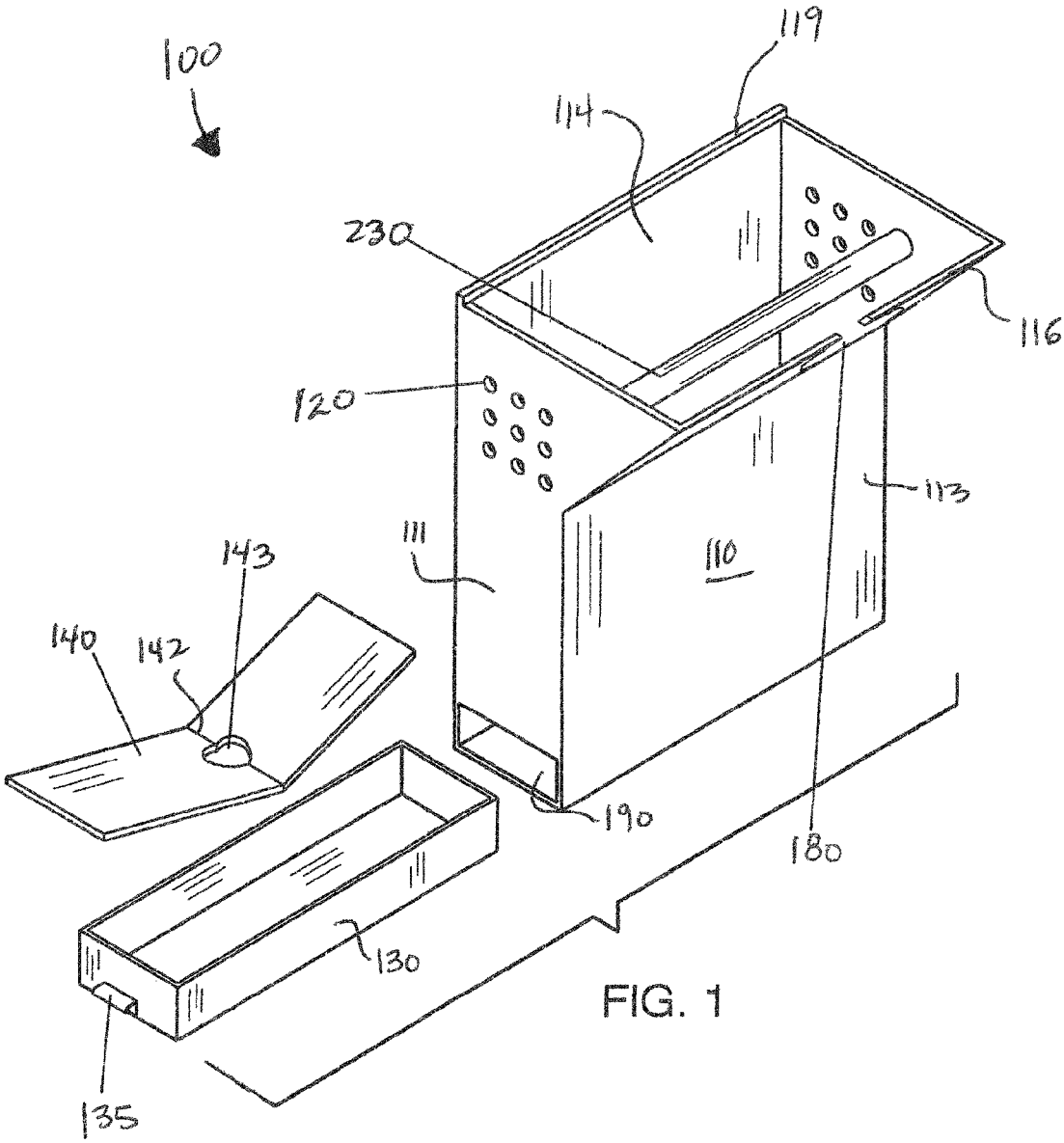
FIG. 1 is a front perspective view of the mop holding device of the present invention.

The following is a listing of numbers corresponding to a particular element refer to herein:

100 mop holding device
101 mop
102 mop head (e.g., yarn)
110 base
111 first side wall of base
112 second side wall of base
113 front wall of base
114 back wall of base
115 bottom wall of base
116 top edge of front wall of base
117 top portion of front wall of base
118 bottom portion of front wall of base
119 top edge of back wall of base
120 ventilation holes
130 tray
135 handle of tray
140 tray cover
142 middle of tray cover
143 tray cover hole
180 mop opening
190 aperture

230 support bar
350 wall
360 mounting bracket
365 mounting bracket clip
370 support component
420 backsplash
430 deodorizing component Referring now to FIGS. 1-5, the present invention features a mop holding device 100. The mop holding device 100 allows for the mop head 102 (e.g., yarn) of a mop 101 to drain. In some embodiments, the mop holding device 100 of the present invention helps to eliminate odors that typically come from damp or wet mops 101. The mop holding device 100 may be attached to a wall 350 or other similar surface.

Figure 2:
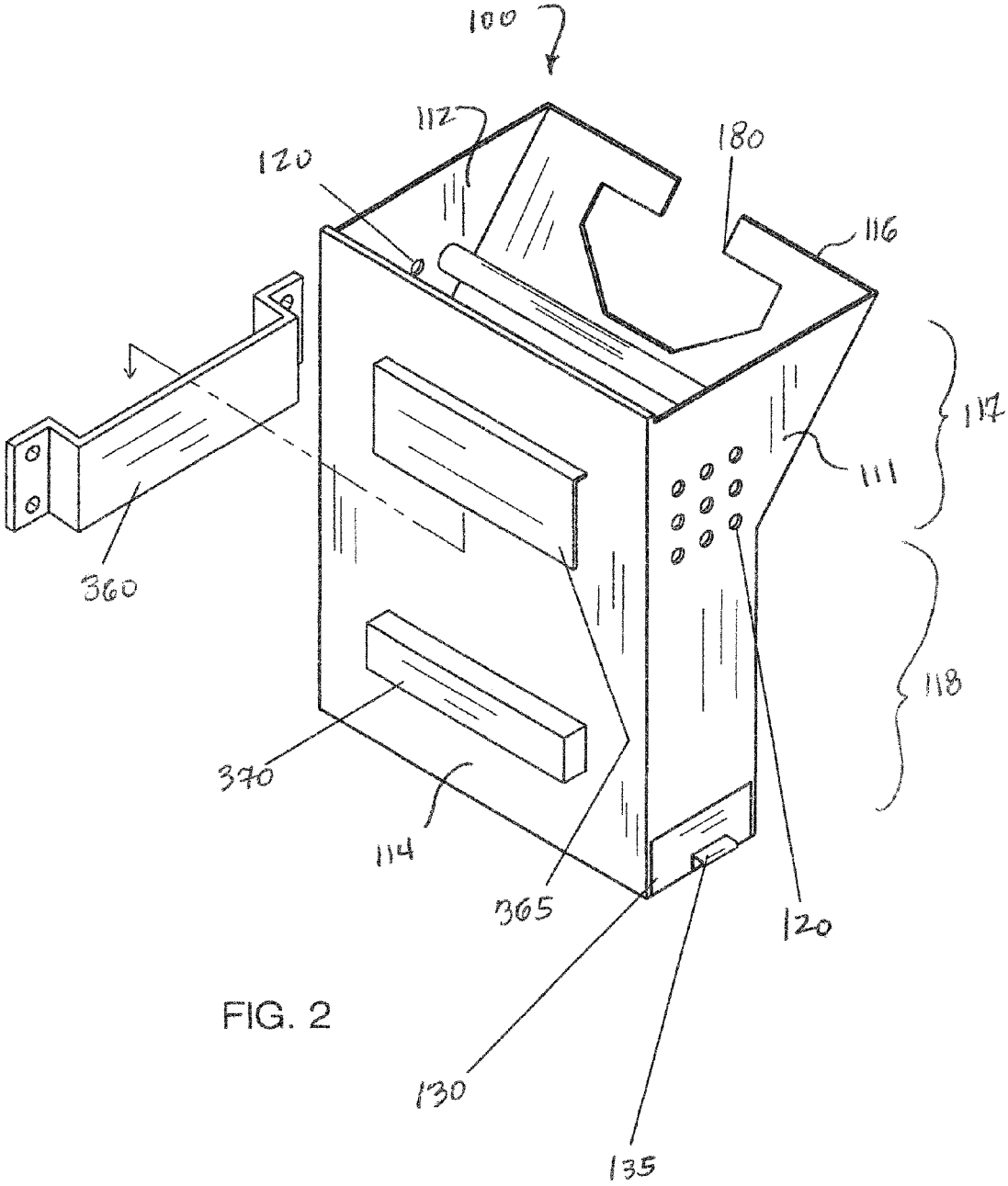
FIG. 2 is a back perspective view of the mop holding device of the present invention.

As shown in FIG. 1 and FIG. 2 the mop holding device 100 comprises a base 110 having a first side wail 111, a second side wall 112, a front wall 113, a back wall 114, a bottom wall 115, an open top, and an inner cavity. In some embodiments, a plurality of ventilation holes 120 is disposed in the first side wall 111 and/or the second side wall 112 of the base 110. The ventilation holes 120 can help allow a wet mop 101 that is inserted into the mop holding device 100 to dry.

As shown in FIG. 1 and FIG. 2, front wall 113 of the base 110 has a top edge 116, a top portion 117 and a bottom portion 118. In some embodiments, the top portion 117 is beveled with respect to the bottom portion 118, for example the top portion 117 is angled such that the top edge 116 of the front wall 113 extends outwardly away from the back wall 114 of the base 110 and the bottom portion 118 of the front wall 113.

Disposed in the front wall 113 of the base 110 at the top edge 116 of the front wall 113 is a mop opening 180. The mop opening 180 is for receiving the mop 101 (e.g., the pole of the mop). In some embodiments, the mop opening 180 extends from the top edge 116 of the front wall 113 downwardly through the top portion 117 of the front wall 113 toward the bottom portion 118 of the front wall 113. The mop 101 is inserted into the mop holding device 100 by placing the mop head 102 in the inner cavity of the base 110 and hanging the pole of the mop 101 over the mop opening 180 outside of the base 110.

The mop holding device 100 further comprises a support bar 230 for helping to support the mop 101 when it is inserted into the mop holding device 100. In some embodiments, the support bar 230 has a first end and a second end, wherein the first end is attached to the first side wall 111 of the base 110 near the open top and the second end is attached to the second side wall 112 of the base 110 near the open top. In some embodiments, the first end of the support bar 230 is attached to the first side wall 111 of the base 110 near the front wall 113 of the base 110. In some embodiments, the second end of the support bar 230 is attached to the second side wall 112 of the base 110 near the front wall 113 of the base 110. In some embodiments, the first end of the support bar 230 is attached to the first side wall 111 of the base 110 about halfway between the front wall 113 and the back wail 114 of the base 110. In some embodiments, the second end of the support bar 230 is attached to the second side wall 112 of the base 110 about halfway between the front wall 113 and the back wall 114 of the base 110.

Figure 4:
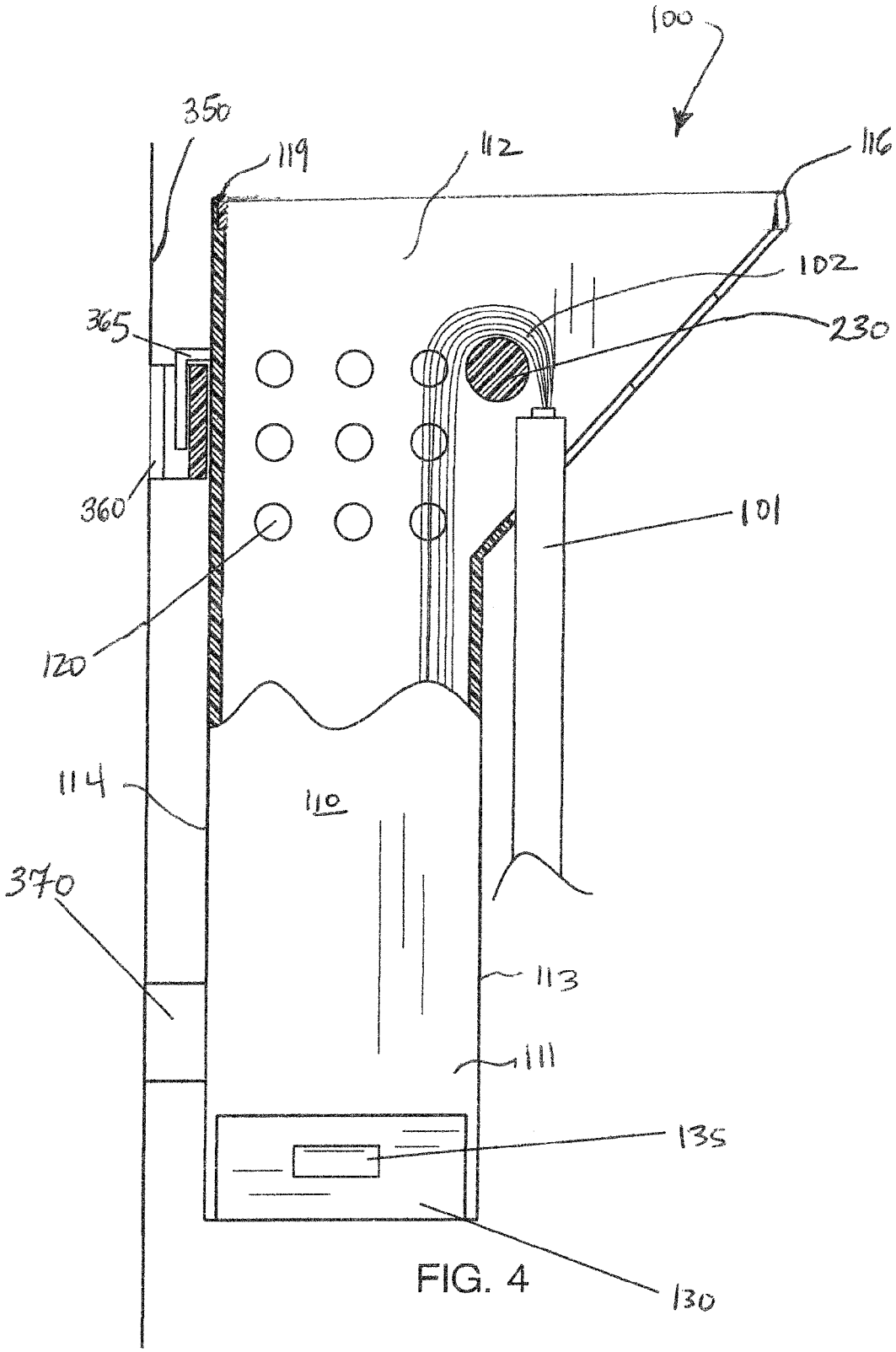
FIG. 4 is a side cross sectional view of the mop holding device of the present invention.

As shown in FIG. 4, in some embodiments, a user can insert the mop head 102 into the inner cavity of the base 110 and over the support bar 230, while allowing the pole of the mop 101 hang over the outside of the base 110 through the mop opening 180.

Figure 3:
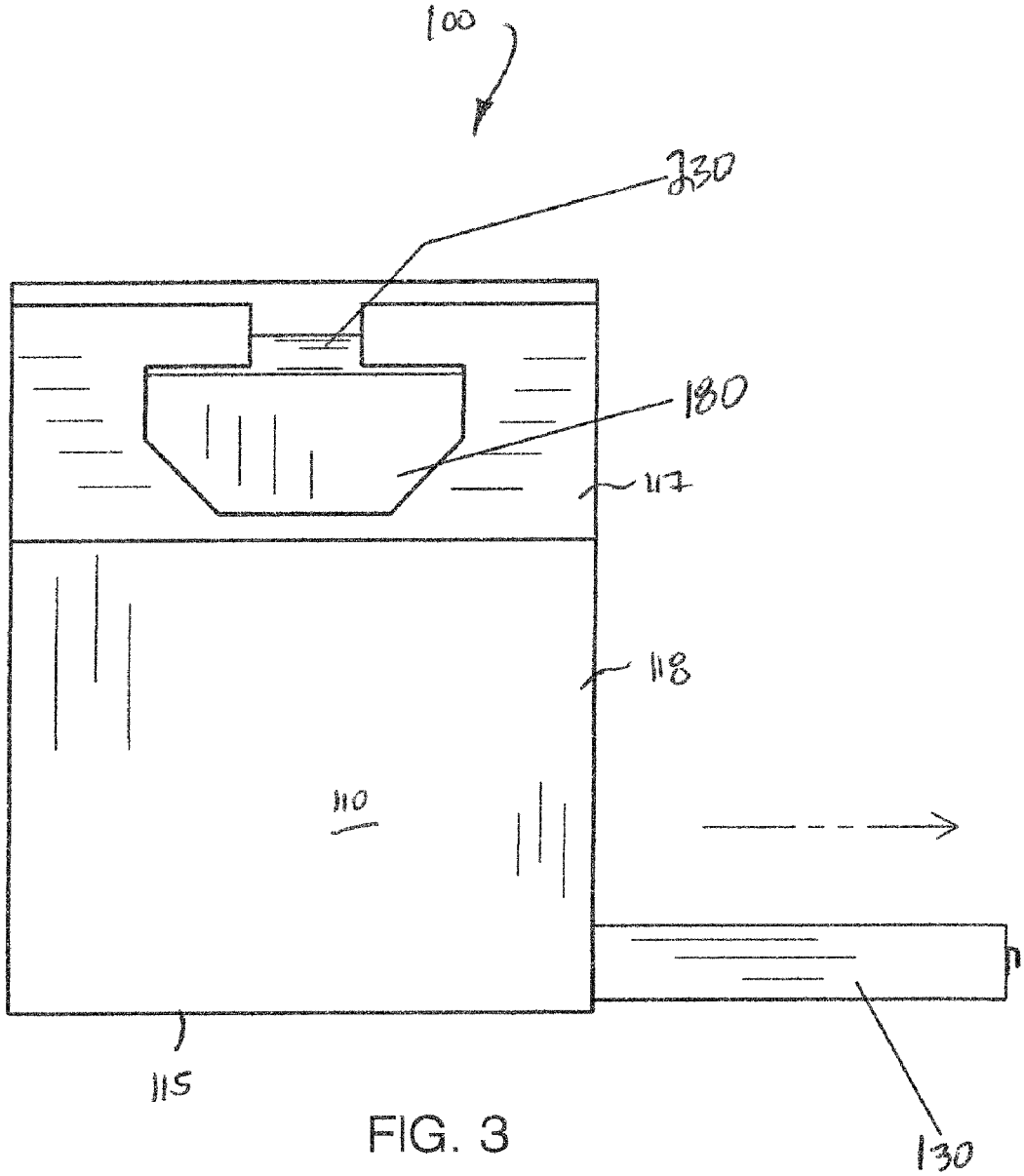
FIG. 3 is a front view of the mop holding device of the present invention.

As shown in FIG. 1 and FIG. 3, in some embodiments, the mop holding device 100 further comprises a removable tray 130 for collecting water from the mop 101. In some embodiments, the removable tray 130 is slidably received in an aperture 190 disposed in the first side wall 111 and/or second side wall 112 near the bottom 115 of the base 110. In some embodiments, a handle 135 is disposed on the tray 130 so as to allow a user to easily slide the tray 130 in and out of the aperture 190 in the base 110, in some embodiments, the tray 130 covers the bottom wall 115 of the base 110. When a wet mop 101 is inserted into the mop holding device 100, water that drips from the mop head 102 can then be collected in the tray 130. When the tray 130 is full, a user can slide the tray 130 out to dispose of the water.

In some embodiments, a tray cover 140 having a tray cover hole 143 is removably attached or removably covers the tray 130. In some embodiments, the tray cover hole 143 is disposed in the middle 142 of the tray cover 140. The tray cover hole 143 is for allowing water to enter into the tray 130 when the tray cover 140 is atop the tray 130. In some embodiments, the tray cover 140 is generally V-shaped or U-shaped, wherein the tray cover hole 143 is disposed in the middle 142 of the tray cover 140 wherein the base of the V-shape or the base of the U-shape is located. The V-shape or U-shape allows water that drips onto the tray cover 140 to be funneled through the tray cover hole 143 into the tray 130.

Figure 5:
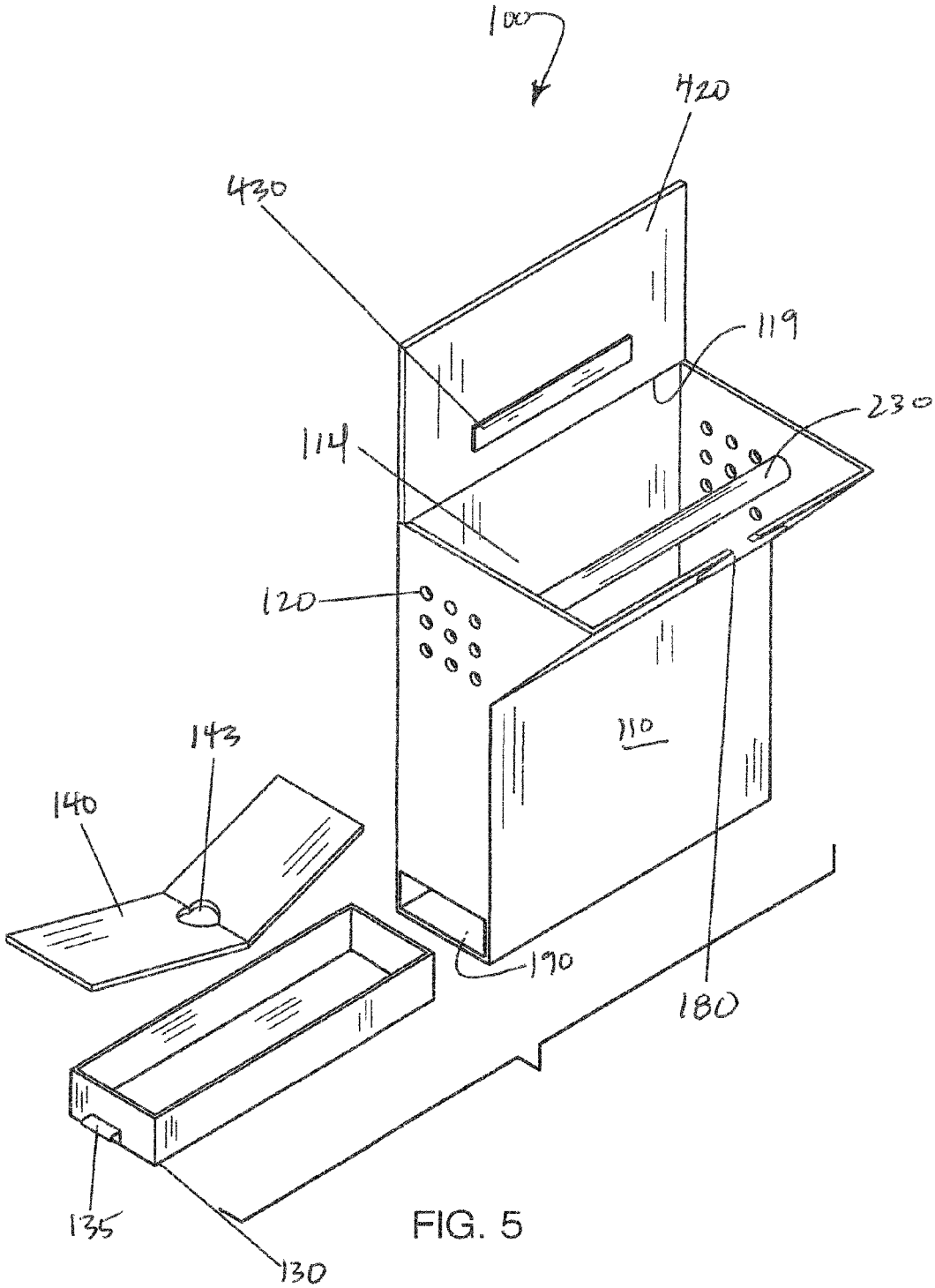
FIG. 5 is a perspective view of the mop holding device of the present invention.

As shown in FIG. 5, in some embodiments, the mop holding device 100 further comprises a backsplash 420. In some embodiments, the backsplash 420 is attached (e.g., removably or permanently) to the top edge 119 of the back wall 114 of the base 110. In some embodiments, the backsplash 420 is pivotally attached to the top edge 119 of the back wall 114 via a hinge.

In some embodiments, a deodorizing component 430 is disposed on the backsplash 420. The deodorizing component 430 can help to reduce odors from the wet mop 101. In some embodiments, the deodorizing component 430 is attached to the backsplash 420 via an adhesive. In some embodiments, the deodorizing component 430 is temporarily covered by a removable backing. The removable backing can help allow the deodorizing scent of the deodorizing component 430 to be preserved until a user is ready to use the deodorizing component 430.

The mop holding device 100 may be attached to a wall 350 or other similar structure. As shown in FIG. 2, in some embodiments, an attachment means is disposed on the back wall 114 of the base 110. In some embodiments, the attachment means includes a hole, a mounting hole for receiving a screw or nail, a clip, the like, or a combination thereof. In some embodiments, the attachment means is a mounting bracket clip 365 for inserting into a mounting bracket 360 attached to a wall 350 or similar structure (see FIG. 2).

In some embodiments, a support component 370 is disposed on the back wall 114 of the base 110 for helping the base 110 remain stable while mounted on a wall 350 or other similar structure. In some embodiments, the support component 370 is constructed from a material comprising a rubber, foam, a plastic, the like, or a combination thereof.

The mop holding device 100 may be constructed in a variety of shapes and/or sizes to accommodate a variety of types and/or sizes of mops. For example, in some embodiments, the base 110 is between about 20 to 25 inches in height as measured from the bottom wall 115 to the top edge 119 of the back wall 119. In some embodiments, the base 110 is between about 25 to 30 inches in height as measured from the bottom wall 115 to the top edge 119 of the back wall 119. In some embodiments, the base 110 is more than about 30 inches in height.

In some embodiments, the base 110 is between about 10 to 15 inches in length as measured from the first side wall 111 to the second side wall 112. In some embodiments, the base 110 is between about 15 to 20 inches in length as measured from the first side wall 111 to the second side wall 112. In some embodiments, the base 110 is more than about 20 inches in length.

In some embodiments, the base 110 is between about 4 to 8 inches in width as measured from the front wall 113 to the back wall 114. In some embodiments, the base 110 is between about 8 to 12 inches in width as measured from the front wail 113 to the back wall 114. In some embodiments, the base 110 is more than about 12 inches in width.

As used herein, the term "about" refers to plus or minus 10% of the referenced number. For example, an embodiment wherein the base 110 is about 20 inches in height includes a base 110 that is between 18 and 22 inches in height.

The following the disclosures of the following U.S. Patents are incorporated in their entirety by reference herein: U.S. Pat. No. 5,335,799; U.S. Pat. No. 4,638,910; U.S. Pat. No. 4,940,139; U.S. Pat. No. 3,780,874; U.S. Pat. No. 4,852,207; U.S. Pat. No. 5,274,877; U.S. Pat. Application No. 2005/0061695.

Various modifications of the invention, in addition to those described herein, will be apparent to those skilled in the art from the foregoing description. Such modifications are also intended to fail within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A mop holding device comprising:

(a) a base comprising a front wall, a back wall, a bottom wall, and an inner cavity, the front wall has a top edge, a top portion, and a bottom portion, wherein the top portion of the front wall is angled with respect to the bottom portion such that the top edge of the front wall extends outwardly away from the back wall of the base;

(b) a plurality of ventilation holes disposed in a first side wall of the base, wherein the ventilation holes can help a mop that is inserted into the mop holding device to dry;

(c) a mop opening for receiving a pole portion of the mop disposed in the front wall, the mop opening extends downwardly from the top edge of the front wall through the top portion of the front wall;

(d) a support bar for helping to support a head of the mop, the support bar having a first end and a second end, wherein the first end is attached to the first side wall of the base near the top edge of the front wall and the second end is attached to a second side wall of the base near the top edge of the front wall; wherein the mop is draped over the mop opening such that the head of the mop is inserted into the inner cavity of the base and over the support bar;

(e) a removable tray for collecting water from the mop slidably received in an aperture disposed in the first side wall near the bottom wall of the base (f) an attachment means for attaching the mop holding device to a wall or similar surface; and (g) a support component disposed on the back wall of the base for helping the base remain stable while mounted on the wall.

2. The mop holding device of claim 1, wherein the mop holding device further comprises a generally V-shaped or U-shaped tray cover having a tray cover hole disposed in a middle area of the tray cover at a base of the V-shaped or U-shaped tray cover, the tray cover is removably attached to the tray; wherein the tray cover hole is for allowing water to enter into the tray when the tray cover is atop the tray.

3. The mop holding device of claim 1, wherein the mop holding device further comprises a backsplash attached to the back wall of the base.

4. The mop holding device of claim 3, wherein a deodorizing component is disposed on the backsplash.

5. The mop holding device of claim 1, wherein a handle is disposed on the tray so as to allow a user to easily slide the tray in and out of the aperture in the base.

6. The mop holding device of claim 1, wherein the attachment means is disposed on the back wall of the base.

7. The mop holding device of claim 6, wherein the attachment means includes a mounting bracket, a mounting bracket clip, a hole for receiving a screw or nail, the like, or a combination thereof.

* * * * *